US006155930A

United States Patent [19]

Madara

[11] Patent Number: 6,155,930

[45] **Date of Patent: *Dec. 5, 2000**

[54] SIGHTING APPARATUS FOR USE WITH A GOLF PUTTER

[76] Inventor: Gerald J. Madara, 29 High View Rd., South Windsor, Conn. 06074

[ * ] Notice: This patent is subject to a terminal disclaimer.

[21] Appl. No.: 09/328,754

[22] Filed: Jun. 9, 1999

[51] Int. Cl.[7] ..... A63B 69/36

[52] U.S. Cl. ..... 473/226; 473/238

[58] Field of Search ..... 473/242, 404, 473/407, 226, 231, 223, 219, 268, 238, 283, 284, 285, 286, 251, 257; 33/263, 227

[56] References Cited

U.S. PATENT DOCUMENTS 4,239,216 12/1980 Bauer .
4,327,916 5/1982 Shiratori .
4,927,151 5/1990 Ronnick .
5,026,062 6/1991 Freeberg .
5,328,174 7/1994 Reeder .
5,415,408 5/1995 Livesay et al. .
5,957,782 9/1999 Madara .

*Primary Examiner*—Sebastiano Passaniti
*Attorney, Agent, or Firm*—J. Stewart Brams

[57] ABSTRACT

A body is attached to a rubber cuff. A sighting tube extends transversely through the body. A notch is depressed into a top face of the body. The notch is positioned at a 90 degree angle with respect to the sighting tube. The sighting apparatus is attached to a putter by inserting a shaft of the putter into the rubber cuff. The sighting apparatus is aligned properly by placing a golf tee or pencil in the notch and rotating the body until the tee or pencil is parallel to a face of a head of the putter. By placing the putter behind a golf ball and sighting a hole through the sighting tube, a golfer can align the face of the head of his or her putter for a proper stroke.

9 Claims, 6 Drawing Sheets

SIGHTING APPARATUS FOR USE WITH A GOLF PUTTER

BACKGROUND OF THE INVENTION

1. Field of the Invention

The present invention relates to golf equipment, particularly to sighting apparatus for use with golf putters.

2. Description of the Related Art

An important requirement of a successful golf putt is proper alignment of the face of the putter head with the hole. This can actually be quite difficult, especially for longer putts. What is needed is a device which assists in aligning the face of the putter head with the hole on a putting green.

SUMMARY OF THE INVENTION

A sighting apparatus comprises a body attached to a rubber cuff. A sighting tube extends transversely through the body. A notch is depressed into a top face of the body. The notch is positioned at a 90 degree angle with respect to the sighting tube. The sighting apparatus is attached to a putter by inserting a shaft of the putter into the rubber cuff. The sighting apparatus is aligned properly by placing a golf tee or pencil in the notch and rotating the body until the tee or pencil is parallel to a face of a head of the putter. By placing the putter behind a golf ball and sighting a hole through the sighting tube, a golfer can align the face of the head of his or her putter for a proper stroke.

Still further features and advantages will become apparent from the ensuing description and drawings.

DETAILED DESCRIPTION

Figure 1:
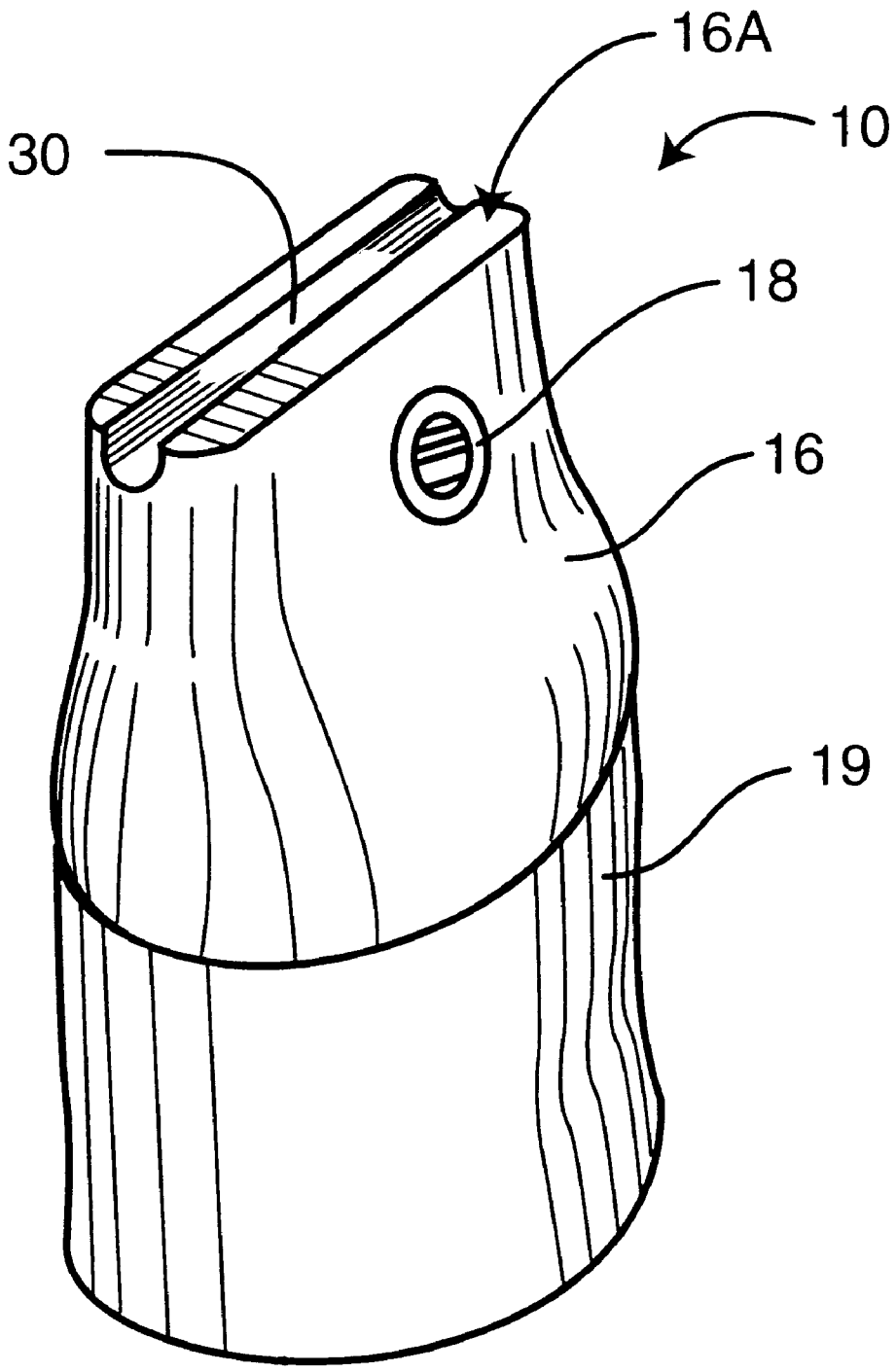
FIG. 1 is a perspective view of a sighting apparatus of the present invention.
Figure 2:
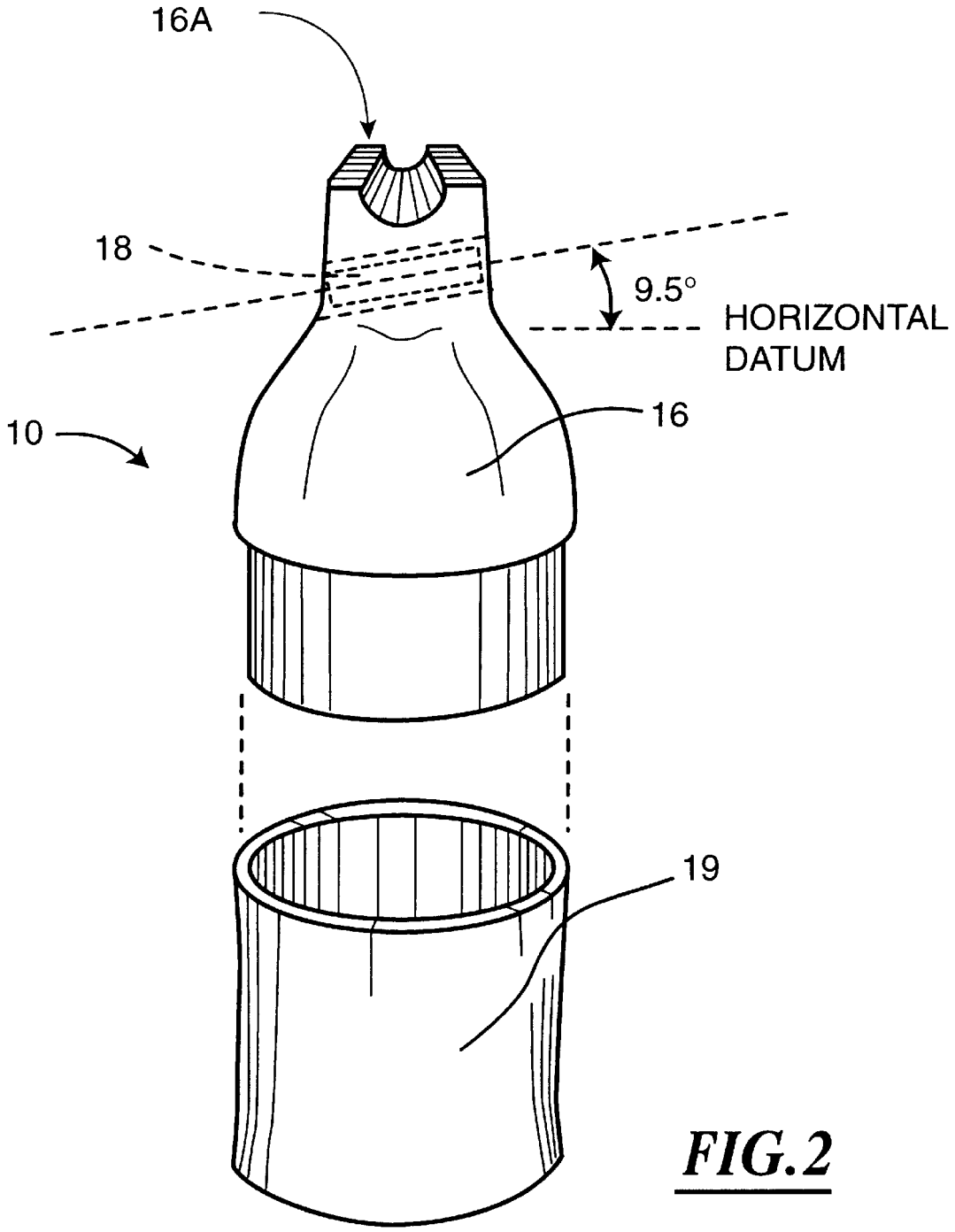
FIG. 2 is an exploded perspective view of the sighting apparatus from another viewpoint.

FIG. 1 is a perspective view of a sighting apparatus 10 of the present invention. The sighting apparatus 10 includes a body 16 attached to a rubber cuff 19. FIG. 2 is an exploded perspective view of the sighting apparatus 10 from another viewpoint, showing the rubber cuff 19 away from the body 16 for clarity. The body 16 is preferably made of molded plastic. A sighting tube 18 extends transversely through the body 16. The sighting tube 18 may be made of brass, plastic or other appropriate material. In one embodiment, when a longitudinal axis of the sighting apparatus 10 is oriented vertically, the sighting tube 18 forms a 9.5 degree angle with a horizontal datum.

A notch 30 is depressed into a top face 16A of the body 16. The notch 30 is positioned at a 90 degree angle with respect to the sighting tube 18.

Figure 3:
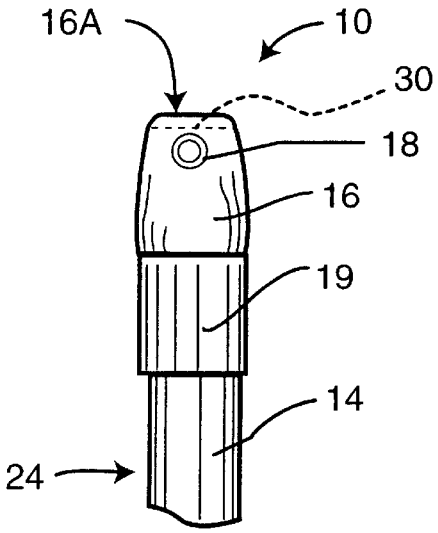
FIG. 3 is a front elevational view of the sighting apparatus attached to a shaft of a golf putter.

FIG. 3 is a front elevational view of the sighting apparatus 10 attached to a shaft 14 of a golf putter 24. The sighting apparatus 10 is attached to the shaft 14 by inserting the shaft 14 into the cuff 19.

Figure 4:
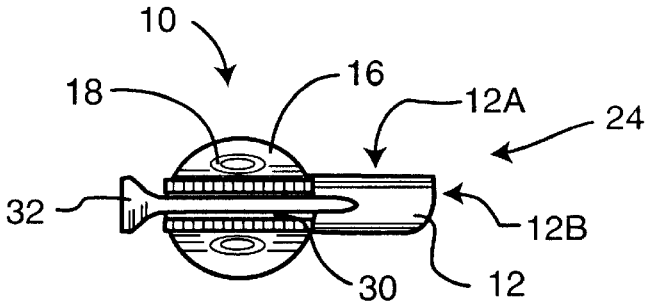
FIG. 4 is a plan view of the sighting apparatus attached to the golf putter.

FIG. 4 is a plan view of the sighting apparatus 10 attached to the golf putter 24. To ensure that the sighting apparatus 10 is properly aligned on the shaft 14 of the putter 24, a golfer (not shown in this view) places a golf tee 32, pencil (not shown) or other implement in the notch 30 and aligns the golf tee 32 so that the golftee 32 is parallel to a face 12A of a head 12 of the putter 24. This ensures that the notch 30 is parallel to the face 12A, and the sighting tube 18 is perpendicular to the face 12A.

Figure 5:
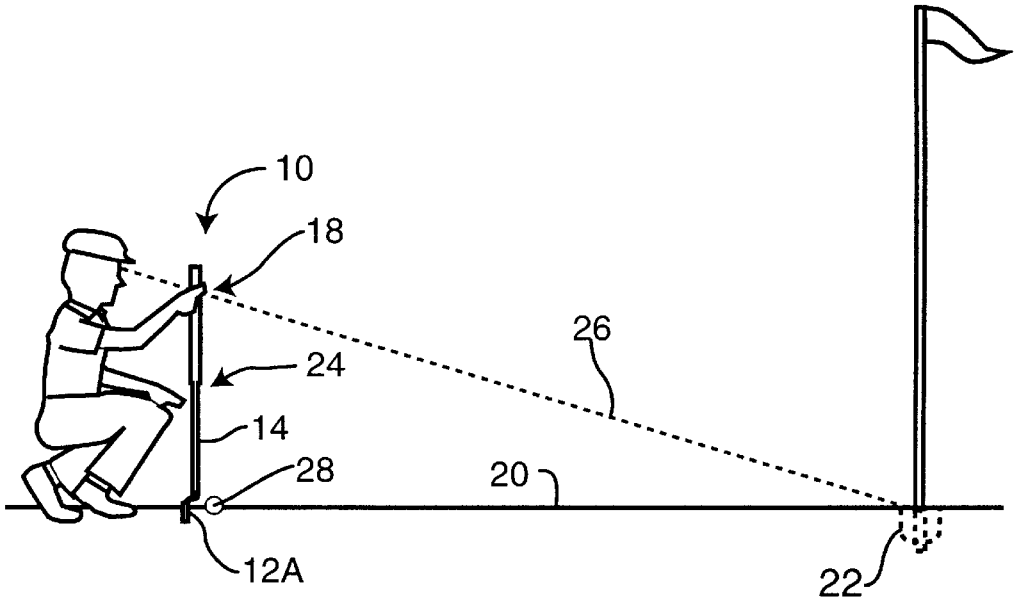
FIG. 5 is an elevational view of a golfer using the sighting apparatus to align the face of the head of the putter with a golf ball.
Figure 5A:
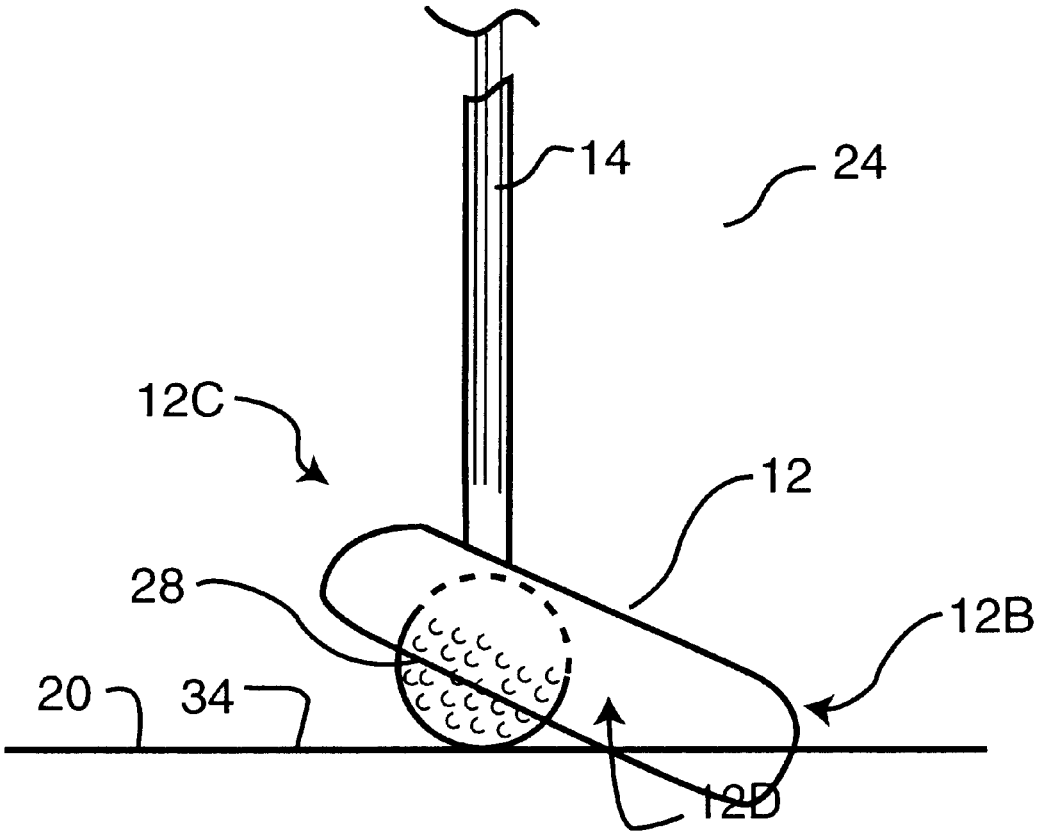
FIG. 5A is a partial enlarged elevational view showing the appropriate position of the golf putter relative to the golf ball when aligning the face of the head of the putter with the golf ball.

FIG. 5 is an elevational a golfer using the sighting apparatus 10 to align the face 12A of the head 12 of the putter 24 with a golf ball 28. FIG. 5A is a partial enlarged elevational view showing the appropriate position of the golf putter 24 relative to the golf ball 28 and to the horizon 34 when aligning the face 12A of the head 12 of the putter 24 with the golf ball 28. A toe 12B of the head 12 rests on the green 20, and the shaft 14 of the putter 24 is perpendicular to the horizon 34. In this view, the green 20 is parallel to the horizon 34 and so is represented by the same line.

Figure 6:
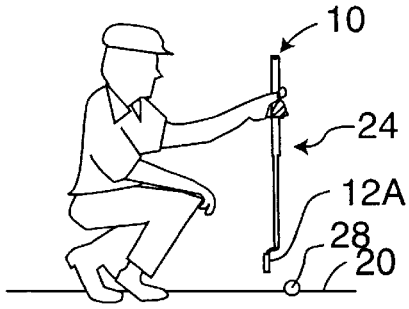
FIGS. 6–6H show the steps involved in properly using the sighting apparatus.
Figure 6A:
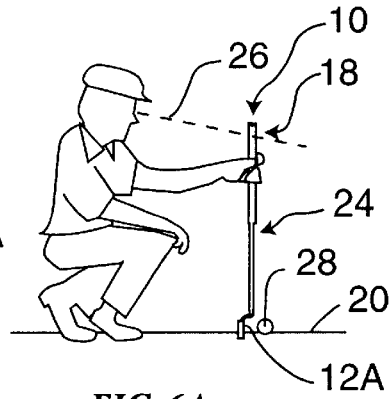
Figure 6B:
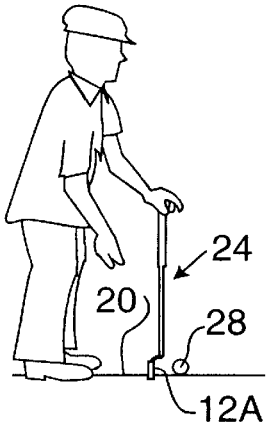
Figure 6C:
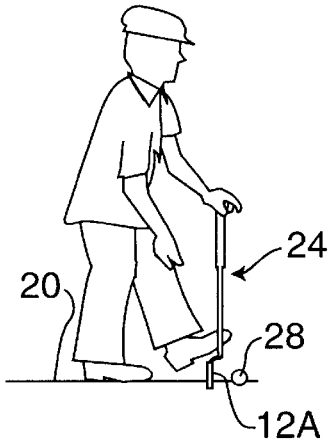
Figure 6D:
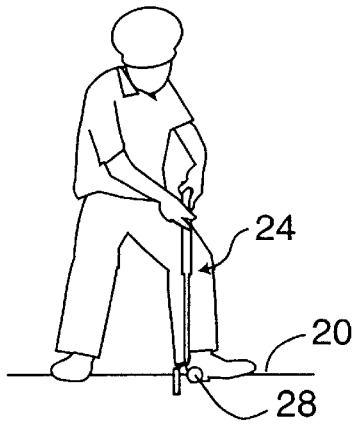
Figure 6E:
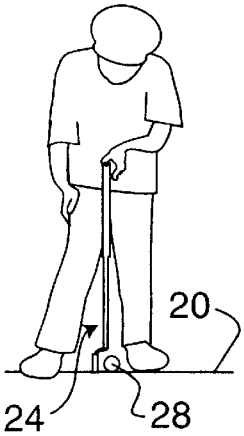
Figure 6F:
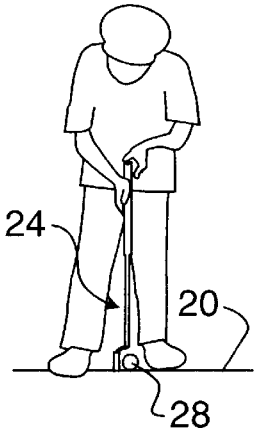
Figure 6G:
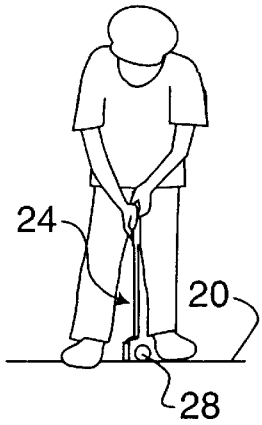
Figure 6H:
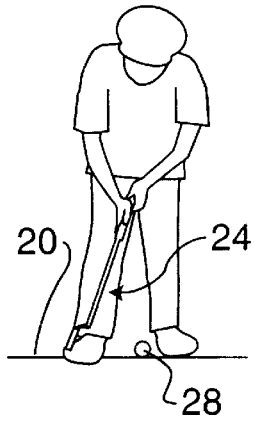

FIGS. 6–6H show the steps involved in properly using the sighting apparatus 10. Referring now to FIG. 6, the golfer places the putter 24 behind the golf ball 28, holding the shaft 14 of the putter 24 beneath the sighting tube 18. The golfer lightly holds the putter 24 so that the head 12 of the putter 24 is suspended above the green 20, and the shaft 14 hangs in a vertical position.

Referring now to FIG. 6A, the golfer then rests the toe 12B of the head 12 of the putter 24 on the green 20, as shown in figure SA. Referring also to FIG. 5, the golfer now looks through the sighting tube 18 to view a hole 22 along a line of sight 26. If the golfer cannot see the hole 22, he or she then rotates the shaft 14 the hole 22 is seen through the sighting tube l8.

When the golfer can view the hole 22 through the sighting tube 18, the face 12A is of the head 12 of the putter 24 is pointed toward the hole 22.

As described above with reference to FIG. 2, a longitudinal axis of the sighting tube 18 forms a 9.5 degree angle with a horizontal datum when the shaft 14 is oriented vertically. When the putter 24 and the sighting apparatus 10 are oriented as shown and described for FIG. 5, assuming the height of the sighting tube 18 is 34.5 inches above the green 20, and assuming that the line of sight 26 is collinear with the longitudinal axis of the sighting tube 18, the hole 22 is viewable through the sighting tube 18 along the line of sight 26 when the golf putter 24 is about 17.2 feet from the hole 22.

By raising his or her eyes, the golfer can increase the angle of the line of sight 26 through the sighting tube 18 with respect to the horizontal datum, thus being able to view the hole 22 through the sighting tube 18 when the distance from the putter 24 to the hole 22 is less than 17.2 feet.

By lowering his or her eyes, the golfer can decrease the angle of the line of sight 26 through the sighting tube 18 with respect to the horizontal datum, thus being able to view the hole 22 through the sighting tube 18 when the distance from the putter 24 to the hole 22 is more than 17.2 feet.

Referring to FIG. 6B, after sighting the hole 22 through the sighting tube 18, the golfer stands, applying slight pressure to the putter 24, keeping the putter 24 resting on the toe 12B, so that the putter 24 will not rotate. It has been found that by applying pressure with the thumb pressed against the notch 30, the putter 24 is held sufficiently stable.

Referring to FIGS. 6C, 6D and 6E, the golfer walks around the putter 24 to the address position, and then lowers the heel 12C (see FIG. 5A) of the head 12 of the putter 24 until the bottom edge 12D of the head 12 rests on the green 20.

Referring to FIG. 6F, the golfer places his or her left hand on the shaft 14. In FIG. 6G, the golfer assumes his or her normal grip. In FIG. 6H, the golfer raises the head 12 slightly and putts the golf ball 28.

Figure 7:
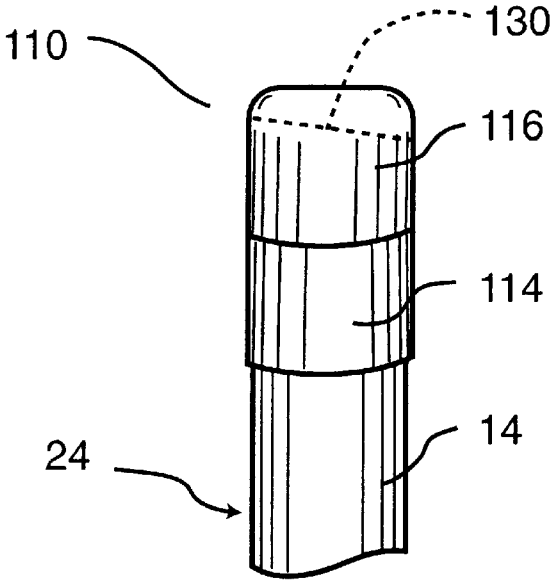
FIG. 7 is a side elevational view of a second embodiment of a sighting apparatus, attached to the shaft of the golf putter.

FIG. 7 is a side elevational view of a second embodiment of a sighting apparatus 110, attached to the shaft 14 of the putter 24. As with the prior described embodiment, the sighting apparatus 110 comprises a body 116 bonded to a rubber cuff 119. In this embodiment, the golfer sights the hole by viewing along a notch 130 on the top face 116A of the body 116.

Figure 7A:
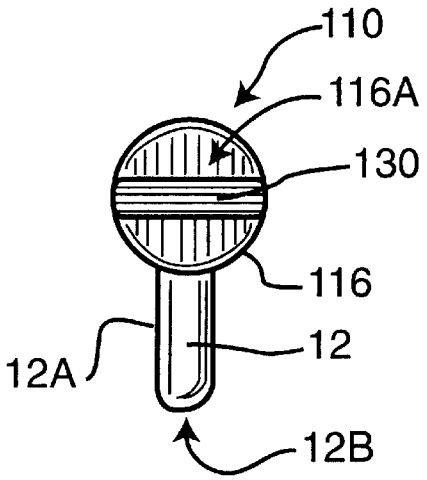
FIG. 7A is a top plan view of the second embodiment of the sighting apparatus attached to the shaft of the golf putter.

FIG. 7A is a top plan view of the second embodiment of the sighting apparatus 110 attached to the shaft 14 of the putter 24. The sighting apparatus 110 is aligned properly when the notch 130 forms a 90 degree angle with the face 12A of the head 12 of the putter 24.

Figure 7B:
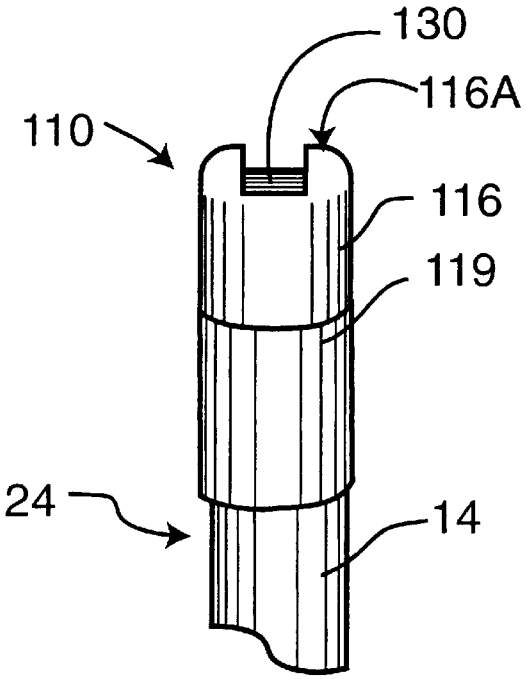
FIG. 7B is a front elevational view of the second embodiment of the sighting apparatus.

FIG. 7B is a front elevational view of the second embodiment of the sighting apparatus 110. Although the notch 130 is shown having a rectangular cross-section, other cross-sections such as V-shapes, half-circles and other conventional shapes are possible.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A sighting apparatus for use with a golf putter, the apparatus comprising:

a. a body having a cuff end opposite a top face;

b. a cuff attached to the cuff end of the body, the cuff adapted to receive a shaft of a golf putter therein, thereby attaching the body to the golf putter;

c. a sighting tube disposed generally transversely through the body; and d. a notch depressed into the top face of the body, the notch positioned at a 90 degree angle with respect to the sighting tube.

2. The sighting apparatus of claim 1, wherein the sighting tube is disposed at an acute angle with respect to a horizontal datum when a longitudinal axis of the apparatus is oriented vertically.

3. The sighting apparatus of claim 1, wherein the cuff is made of rubber and the body is made of molded plastic.

4. A sighting apparatus for use with a golf putter, the apparatus comprising:

a. a body having a top face opposite an attachment end;

b. the body adapted to attach to an end of a shaft of a golf putter at the attachment end of the body;

c. a sighting tube disposed generally transversely through the body; and d. a notch depressed into the top face of the body, the notch positioned at a 90 degree angle with respect to the sighting tube.

5. The sighting apparatus of claim 4, wherein the sighting tube is disposed at an acute angle with respect to a horizontal datum when the body is attached to an end of a shaft of a golf putter and the shaft of the golf putter is oriented vertically.

6. The sighting apparatus of claim 4, wherein the sighting tube is disposed at an acute angle with respect to a horizontal datum when a longitudinal axis of the apparatus is oriented vertically.

7. A sighting apparatus for use with a golf putter, the apparatus comprising:

a. a body having a top face opposite an attachment end;

b. the body adapted to attach to an end of a shaft of a golf putter at the attachment end of the body; and c. a notch depressed into the top face of the body, a base of the notch positioned at an acute angle with respect to a horizontal datum when a longitudinal axis of the apparatus is oriented vertically.

8. The sighting apparatus of claim 7, further comprising a cuff attached to the attachment end of the body, the cuff adapted receive a shaft of a golf putter therein, thereby attaching the body to the golf putter.

9. The sighting apparatus of claim 8, wherein the cuff is made of rubber and the body is made of molded plastic.

* * * * *